United States Patent [19]

Kawakami et al.

[11] Patent Number: 4,674,236

[45] Date of Patent: Jun. 23, 1987

[54] POLISHING MACHINE AND METHOD OF ATTACHING EMERY CLOTH TO THE POLISHING MACHINE

[75] Inventors: Hideo Kawakami, Numazu; Shinichi Tazawa, Mishima; Masami Endo, Shizuoka; Masaharu Kinoshita, Yamagata, all of Japan

[73] Assignee: Toshiba Machine Co., Ltd., Tokyo, Japan

[21] Appl. No.: 838,584

[22] Filed: Mar. 11, 1986

Related U.S. Application Data

[62] Division of Ser. No. 733,258, May 13, 1985.

[51] Int. Cl.[4] ..... B24B 1/00

[52] U.S. Cl. ..... 51/325; 51/293

[58] Field of Search ..... 51/325, 263, DIG. 34, 51/293, 209 R; 30/358

[56] References Cited

U.S. PATENT DOCUMENTS 2,432,176 12/1947 Schubring ..... 30/358

2,598,042 5/1952 Dritz ..... 30/358

3,978,621 9/1976 Janssen ..... 51/263

FOREIGN PATENT DOCUMENTS 0171256 10/1983 Japan ..... 51/131.4

*Primary Examiner*—Frederick R. Schmidt

*Assistant Examiner*—Robert A. Rose

*Attorney, Agent, or Firm*—Oblon, Fisher, Spivak, McClelland & Maier

[57] ABSTRACT

A polishing machine has an upper polishing plate and a lower polishing plate provided below the upper polishing plate. The upper polishing plate has slurry passages. Plugs for supplying slurry are detachably quick coupled to the slurry passages. A piece of polishing pad is bonded to the lower surface of the upper polishing plate. After a spent polishing pad has been removed and a fresh polishing pad has been attached to the lower surface of the upper polishing plate, a hole-cutter is downwardly inserted in each slurry passage until it pierces the fresh polishing pad, thus cutting a hole in the polishing pad.

4 Claims, 15 Drawing Figures

POLISHING MACHINE AND METHOD OF ATTACHING EMERY CLOTH TO THE POLISHING MACHINE

This is a division of application Ser. No. 733,258, filed May 13, 1985.

FIELD OF THE INVENTION

The present invention relates to a polishing machine and a method of attaching a polishing pad to the polishing machine.

BACKGROUND OF THE INVENTION

Some kinds of thin workpieces (e.g., a wafer on which an IC device is to be formed) must be polished with a high precision to have a flat surface. One or both surfaces of these workpieces are polished by polishing machines. A machine which can polish both surfaces of such a workpiece is known. As shown in FIG. 1, this machine comprises an upper polishing plate 2 and a lower polishing plate 4 located below the plate 2. Two pieces 6 and 8 of a polishing pad are bonded to the opposing surfaces of the polishing plates 2 and 4. The machine further comprises a tank 10 containing slurry. The slurry is supplied from the tank 10 to the polishing pad 6 through a hose 11 and a passage hole 12 cut in the plate 2 and is used as an abrasive. The passage 12 communicates with a hole 14 which is cut in a piece of the polishing pad 6. Two plugs 16 and 18 are secured to the ends of the hose 11 and detachably attached to the tank 10 and the upper polishing plate 2, respectively.

The polishing pad 6 bonded to the lower surface of the upper polishing plate 2, which consists of three plates 20, 22 and 24, can be replaced by a new one in the following steps:

1. First, the lowest plate 24 is removed from the plates 20 and 22, which are fastened together.
2. The plate 24 is turned upside down, so that the pad 6 faces up. The pad 6 is peeled off the plate 24, and a new emery cloth is bonded to the plate 24.
3. That portion of the new polishing pad 6 which is directly above the passage 12 of in the plate 24 is detected by touching the pad with one's fingers or piercing the pad with a needle. The hole 14 is then cut in the detected portion of the pad 6 with a rod-shaped cutter or a razor.
4. The plate 24 is again turned over and placed on the lower polishing plate 4.
5. The plate 24 is moved until the passage 12 is axially aligned with those of the plates 20 and 22. The plate 24 is fastened to the plates 20 and 22 with bolts 26 (only one is shown in FIG. 1).

Much time is needed to remove the plate 24 from the plates 20 and 22 and fasten it thereto. Since the plate 24 is too heavy for one person to hold, two or more people must cooperate to replace the polishing pad 6 with a new piece. Further, every time the pad 6 is changed, the plate 24 must be moved. There is the risk that, if the plate 24 hits something, its flat surface would be impaired. If the plate 24 becomes less flat, the workpiece polished by the apparatus cannot be as flat as desired.

When the hole 14 is cut in the polishing pad 6, small scraps of cloth inevitably fall into the passage 12 in the plat 24. Unless these scraps are removed from the passage 12, slurry cannot flow smoothly through the hole 12.

OBJECT OF THE INVENTION

Accordingly, the object of the present invention is to provide a polishing machine which can polish workpieces to a high precision and with which it is easy to change its polishing pad, and to provide a method of attaching a polishing pad to the machine.

SUMMARY OF THE INVENTION

According to an aspect of the invention, there is provided a machine for simultaneously polishing a plurality of workpieces with slurry, comprising: a lower plate for supporting workpieces; a rotatable upper polishing plate having a plurality of slurry passages and provided above the lower plate for polishing the upper surface of each workpiece mounted on the lower plate, a piece of the polishing pad being bonded to the surface opposing the lower plate and said slurry being supplied to the polishing pad through the slurry passages; slurry supply means for supplying the slurry to the slurry passages; and coupling means for quick-coupling the slurry supply means to the upper polishing plates.

According to another aspect of the invention, there is provided a method of attaching a polishing pad to a machine which can simultaneously polish a plurality of workpieces with slurry and which comprises an upper polishing plate with slurry passages, a lower plate for supporting workpieces, a polishing pad adhered to the surface of the upper polishing plate, and plugs attached to the upper polishing plate for supplying slurry to the slurry passages. The method comprises the steps of: detaching the plugs from said upper polishing plate; adhering a new polishing pad to the upper polishing plates; placing the upper plate on the lower plate; and inserting a hole cutter downwardly into the slurry passages until the tip of the cutter pierces the polishing pad adhered to the upper polishing plate, thereby cutting a hole in the polishing pad which communicates with the slurry passages.

DETAILED DESCRIPTION OF THE PREFERRED EMBODIMENTS

One embodiment of the invention will be described with reference to FIGS. 2–9.

Figure 1:
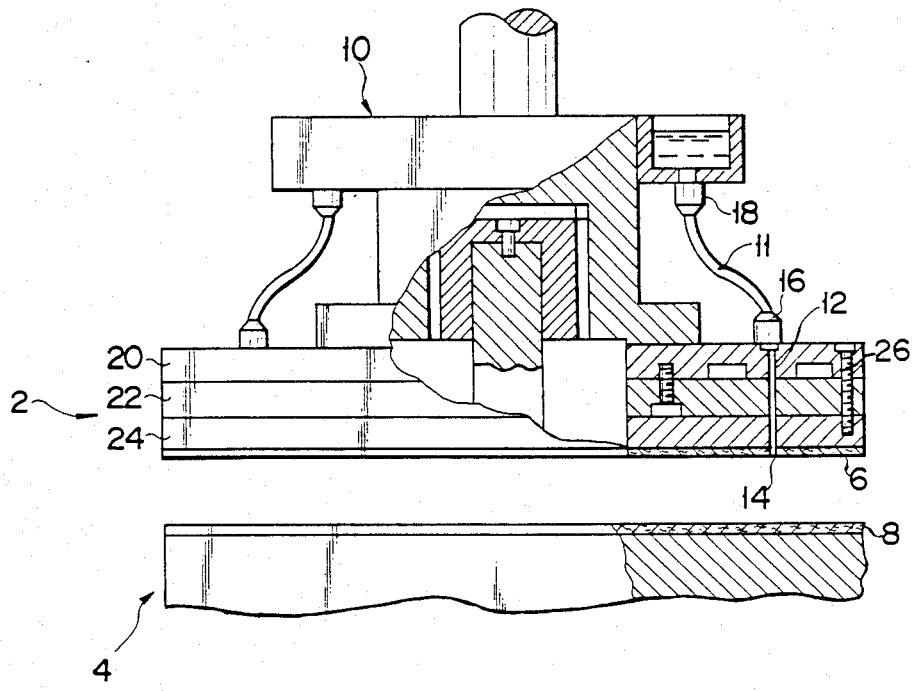
FIG. 1 PRIOR ART
FIG. 1 is a partial cross-sectional, side view of the conventional polishing machine.
Figure 2:
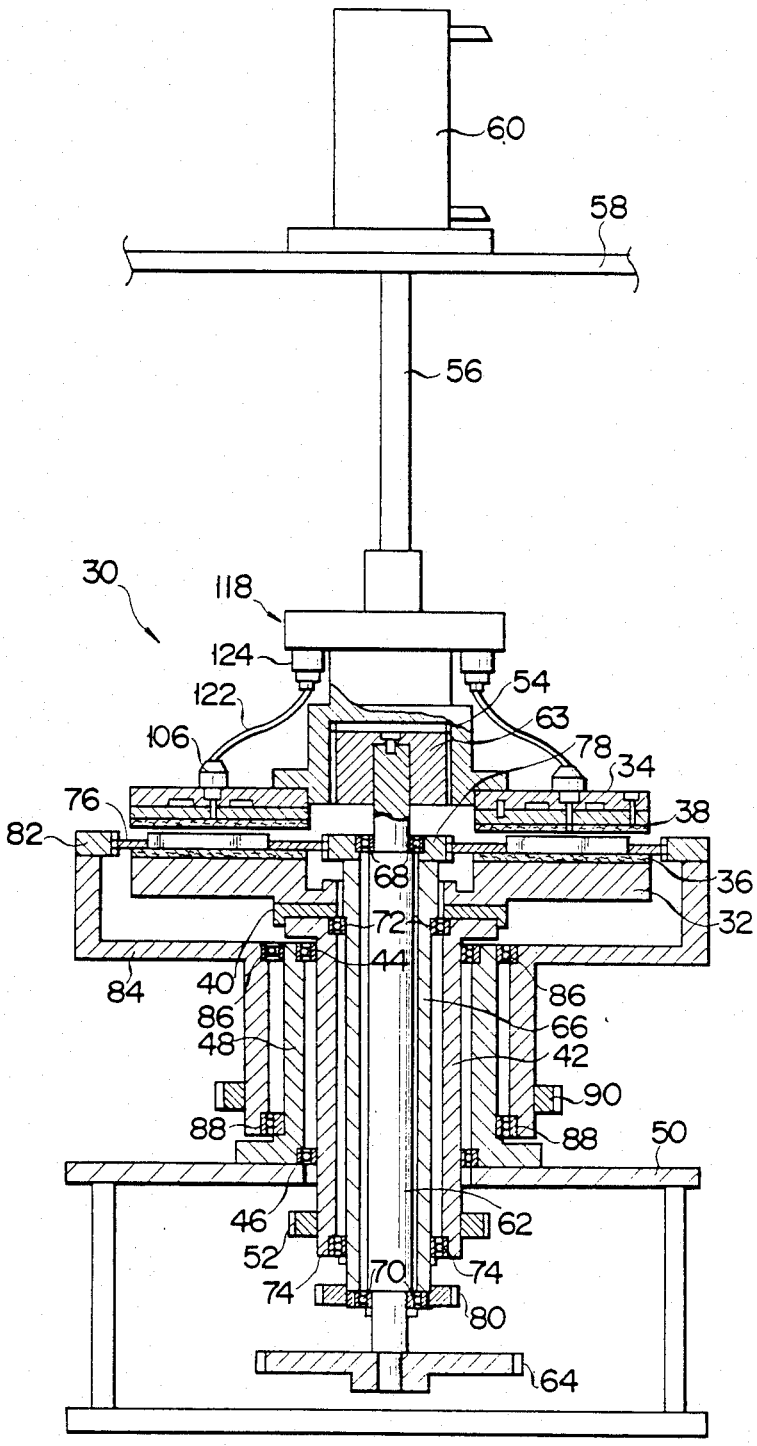
FIG. 2 is a partial cross-sectional, side view of a polishing machine according to the present invention.

As shown in FIG. 1, the embodiment, or a polishing machine 30, comprises a lower polishing plate 32 and an upper polishing plate 34. The plates 32 and 34 are disks, the former being positioned below the latter. Two pieces 36 and 38 of a polishing pad, such as unwoven polyester cloth or foamed polyurethane cloth, are bonded to the opposing surfaces of polishing plates 32 and 34.

A first hollow shaft 42 is attached to the lower surface of the lower polishing plate 32, axially aligned to the plate 32. The upper end of the shaft 42 is attached to a plate 40. The lower end of a hollow cylinder 48 is supported by a base 50. The hollow cylinder 48 is coaxial with plate 40 and surrounds the shaft 42. Bearings 44 and 46 are secured to the inner periphery of the cylinder 48, at the upper and lower end portions thereof. The bearings 44, 46 support the shaft 42 so that it can rotate. A gear 52 is mounted on the lower end portion of the shaft 42. The gear 52 is driven by a drive means (not shown) to rotate the lower polishing plate 32.

The upper polishing plate 34 is suspended by a coupling 54 from the lower end of the a piston rod 56. The upper end of rod 56 is coupled to a piston located in a main cylinder 60 secured to a frame 58. As the piston moves up and down in the cylinder 60, plate 34 also moves up and down. The coupling 54 is shaped like a cap. Spline grooves are cut in its inner periphery. A spline shaft 63 is inserted in the coupling 54. The spline shaft 63 can slide up and down in the coupling 54, but it cannot rotate. The lower end of the spline shaft 63 is attached to the upper end of a shaft 62 coaxially arranged within the first hollow shaft 42. A gear 64 is mounted on the lower end portion of the shaft 62. The gear 64 is rotated by a drive means (not shown) in the direction opposite to the gear 52 mounted on the first hollow shaft 42, whereby the upper polishing plate 34 is rotated in the opposite direction to the lower polishing plate 32.

A second hollow shaft 66 is provided between, and coaxially with, the first hollow shaft 42 and the shaft 62. Two bearings 68 and 70 are attached to the inner periphery of the second hollow shaft 66, at the upper and lower end portions thereof, to support the shaft 62 rotatably. Similarly, two bearings 72 and 74 are attached to the inner periphery of the first hollow shaft 42, at the upper to lower end portions thereof, and support the second hollow shaft 66. A sun gear 78 is secured to the upper end portion of the second hollow shaft 66. The sun gear 78 meshes with a plurality of carriers 76. A gear 80 is attached to the lower end portion of the shaft 66. The gear 80 is rotated by a drive means (not shown) to rotate the sun gear 78. A ring-shaped internal gear 82 is attached to the upper end of a hollow cylindrical support 84. The lower end portion of the support 84 surrounds the hollow cylinder 48. Two bearings 86 and 88 are attached to the outer periphery of the support 84, at the upper and lower end portions thereof. The support 84 is rotatably supported by bearings 86 and 88. A gear 90 is mounted on the lower end portion of the support 84 and is driven by a drive means (not shown) to rotate the gear 82.

Figure 3:
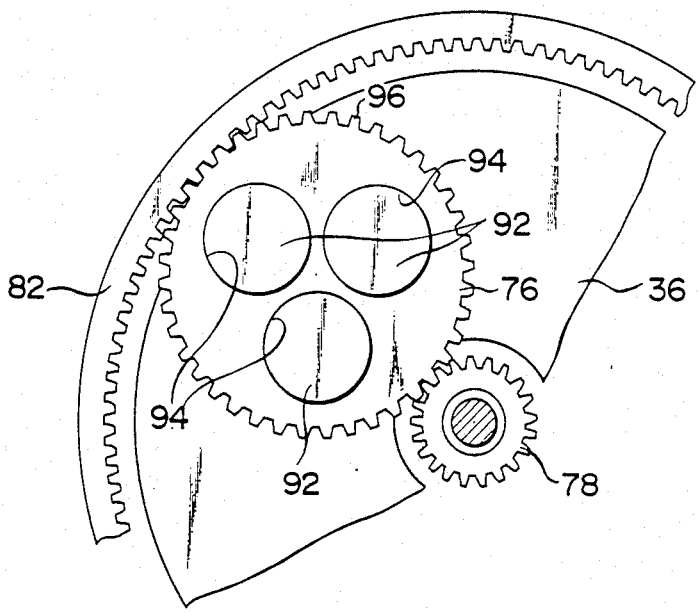
FIG. 3 is a plan view showing part of the lower polishing plate of the machine shown in FIG. 2.
Figure 4:
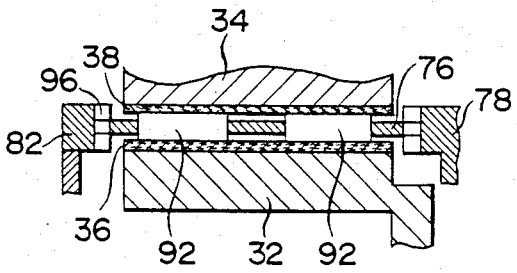
FIG. 4 is a cross-sectional view of the polishing plates of the machine, illustrating how to polish a workpiece.

The carriers 76 are identical, and only one of them will now be described with reference to FIGS. 3 and 4. The carrier 76 is a circular gear with teeth 96. It has three openings 94 arranged in a circle at regular intervals. Wafers 92 are held in the openings 94. The carrier 76 meshes with sun gear 78 and also with the internal gear 82. The carrier 76 revolves and, at the same time, rotates around the sun gear 76 so that the wafers 92 may be polished.

Figure 5:
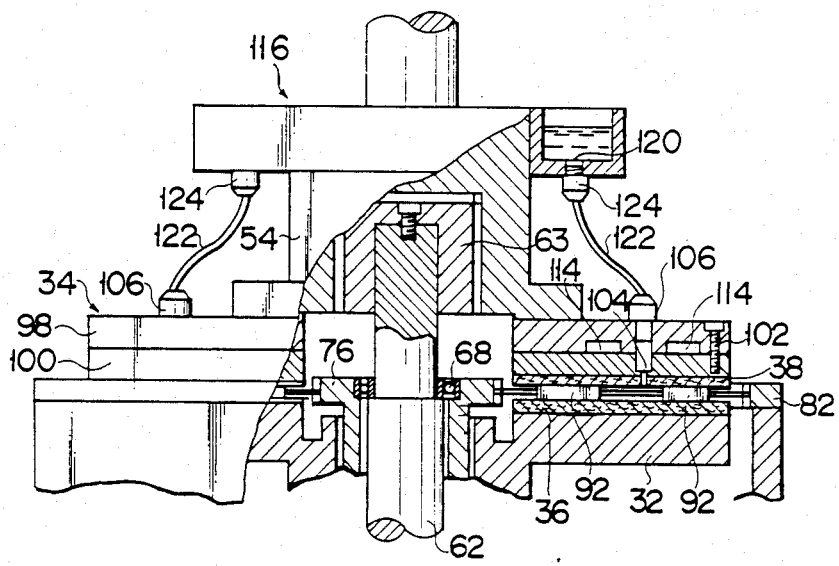
FIG. 5 is a partial cross-sectional, side view showing the main parts of the machine.
Figure 6:
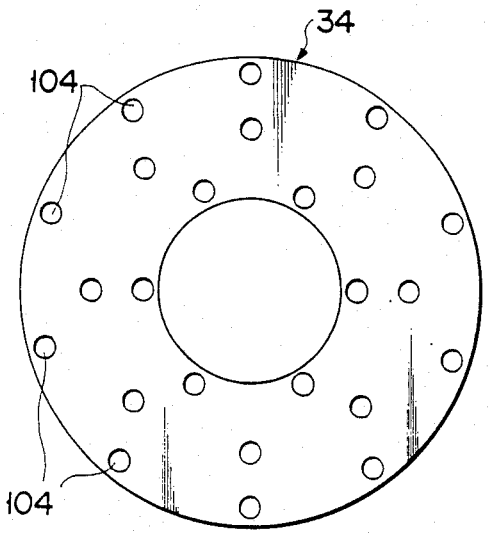
FIG. 6 is a plan view of the upper polishing plate of the machine.
Figure 7:
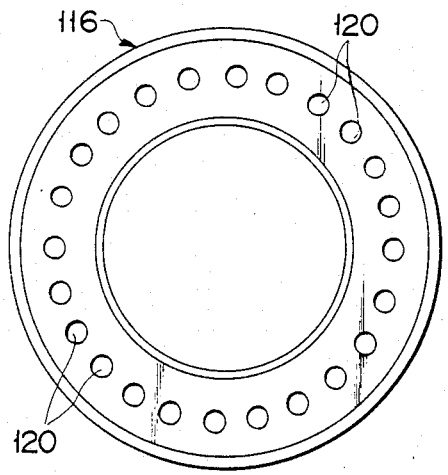
FIG. 7 is a plan view of the slurry tray of the machine shown in FIG. 2.
Figure 8:
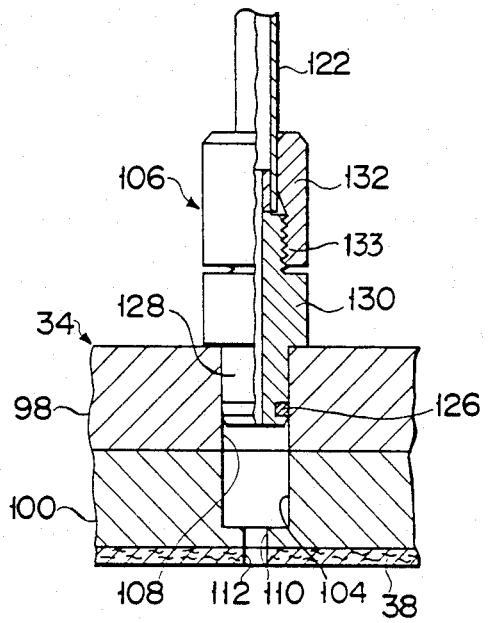
FIG. 8 is an enlarged, partial cross-sectional, side view showing the slurry supply passage and plug of the machine.

With reference to FIGS. 5–8, the upper polishing plate 34 will be described in more detail. The plate 34 consists of two plates 98 and 100 which are, as shown in FIG. 5, fastened together by bolts 102. The plate 24 has passages or through holes 104. Each passage 104 is cut in both the plates 98 and 100 as shown in FIG. 8; it consists of a large-diameter portion 108 cut in the upper plate 98 and in the upper surface region of the lower plate 100 and a small-diameter portion 110 cut in the lower surface region of the lower plate 100. The large diameter portions 108 have a diameter of 10–15 mm, and the small diameter portions 110 have a diameter of 6 mm. Plugs 106 are inserted in the large diameter portions 108. Holes 112, which communicate with the small diameter portions 110, are cut in the polishing pad 38 bonded to the lower plate 100.

As shown in FIG. 5, two concentric annular grooves 114 are cut in the lower surface of the upper plate 98. The grooves 114 and the upper surface of the lower plate 100 define water passages through which cooling water may flow to cool the upper polishing plate 34. The passages 104, through which slurry may be supplied to the polishing pad 38, are arranged in three concentric circles as shown in FIG. 6. The annular grooves 114 are positioned among these circles.

A slurry tray 116 is provided above the upper polishing plate 34. The slurry tray 116 is attached to the coupling 54. As shown in FIG. 7, holes 120 are cut in the bottom of the tray 116. The number of the holes 120 is the same as the number of passages 104 through the upper polishing plate 34. The tray 116 usually holds slurry used as abrasive for polishing wafers. If necessary, it may hold cleaning liquid. The holes 120 are connected to the passages 104 by holes 122. More specifically, the upper ends of the hoses 122 are coupled to plugs 124 screwed in the holes 120, and the lower ends of the hoses 122 are connected to the plugs 106. The plugs 106 can easily be pulled from the passages 104 through the upper polishing plate 34.

As shown in FIG. 8, an O-ring 126 is attached to the lower end portion 128 of each plug 106. The O-ring 126 resiliently contracts as the plug 106 is pushed into the large diameter portion 108 of the passage 104. Once the plug 106 has been inserted into the large diameter portion 108 of the passage 104, it is resiliently held therein by the O-ring 126.

Each plug 106 consists of a main body 130 and a cap 132. The main body 130 has two end portions—i.e., the lower end portion 128 inserted in the large diameter portion 108 of the passage 104 and an upper end portion 133 screwed in the cap 132. The cap 132 is a hollow cylinder, and the lower end portion of the hose 122 is inserted in its upper end portion.

With the machine of the structure described above, slurry flows down under its own weight from the tray 116 to the polishing pad 38. Both the polishing pad 36 and the polishing pad 38 are clogged or worn too much after polishing about 50 to 100 sets of wafers. They need to be replaced by new the polishing pads. It will be explained how pieces 36 and 38 are replaced by new ones.

Figure 9:
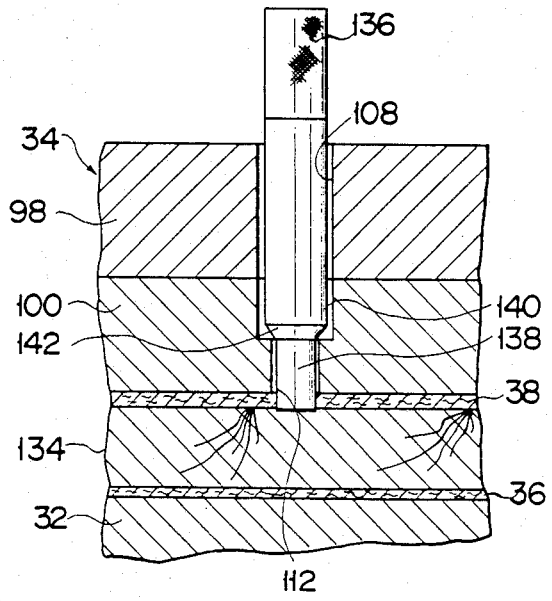
FIG. 9 is an enlarged, partial cross-sectional, side view showing the main parts of the machine and illustrating how to cut a hole in a polishing pad.

First, the piston in the main cylinder 60 is moved up, thus lifting the upper polishing plate 34. The plugs 106 are pulled from the large diameter portions 108 of the passages 104 in the plate 34. This can be done very easily, since the plugs 106 are resiliently held in the large diameter portions 108 of the passages 104 by the O-rings 126. Thereafter, the polishing pad 38 is peeled off the plate 98. The polishing pad 36 is also peeled off the lower polishing plate 32. A new polishing pad 36 is bonded to the upper surface of the plate 32. A disk 134 made of wood and having the same diameter as the upper polishing plate 34 is placed on the new polishing pad 36. (The disk 134 may be made of plastic, rubber or any other material which is far softer than a hole-cutter 136.) A new polishing pad 38 is laid on the disk 134 with its adhesive-applied surface turned upward. The piston in the main cylinder 60 is then lowered until the upper polishing plate 34 contacts the new polishing pad 38. The hole-cutter 136 is inserted into each passage 104. (The hole-cutter 126 is a rod having a hollow cylindrical tip 138 slightly smaller in diameter than the small-diameter portions 110 of the passages 104, a handle 140 larger in diameter than the small-diameter portions 110 and slightly smaller in diameter than the large-diameter portions 108 of the passages 104, and a taper portion 142 connecting the tip 138 to the handle 140.) The hole-cutter 136 is pushed down, by hitting the upper end with a hammer, for example, until the tip 138 pierces the polishing pad 38 and bites into the disk 134 as illustrated in FIG. 9, thereby cutting a hole 112 in the polishing pad 38. Once the taper portion 142 has reached the stepped portion of the passage 104, the tip 138 cannot bite any more deeply into the disk 134, which prevents unnecessary damage to the disk 134. After all the holes 112 have been cut in the polishing pad 38, the upper polishing plate 34 is lifted again. The plugs 106 are fitted into the large-diameter portions 108 of the passages 104.

With this method, scraps of the polishing pad 38 are left on the disk 134 or within the tip 138 of the hole-cutter 136, but never left in the passage 104. The lower plate 100 need not be removed to change the polishing pad 38 or to cut the holes 112 in the new polishing pad 38. Hence, only one worker can change the polishing pad, and there is no risk that the plate 24 will hit something and therefore have its flatness impaired, and thus fail to polish the wafers as flat as desired.

The present invention is not limited to the above embodiment. Various changes and modifications can be made within the scope of the invention.

Figure 10:
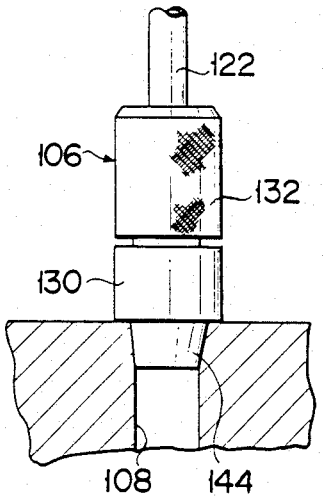
FIGS. 10–15 show various plugs that may be used in the present invention to connect a slurry supply hose to the upper polishing plate.
Figure 11:
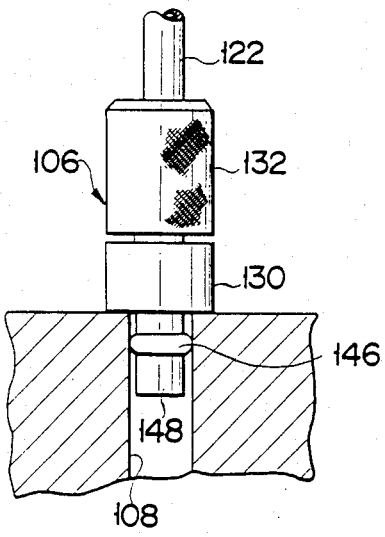
Figure 12:
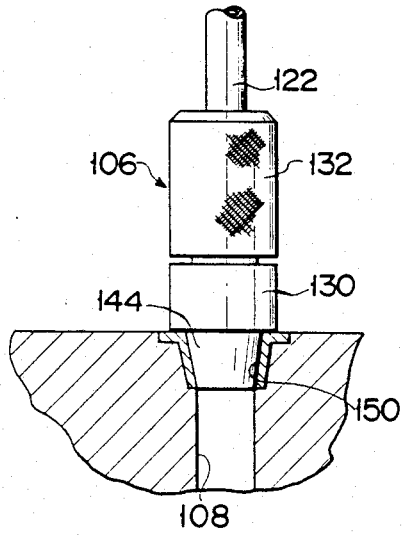
Figure 13:
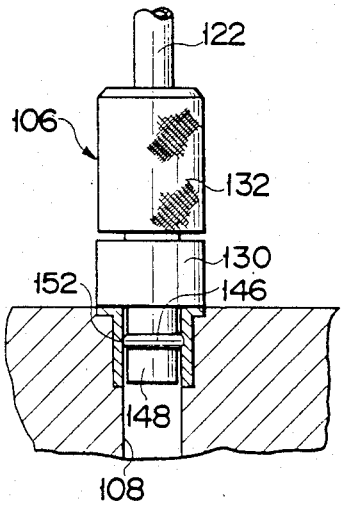

For example, each plug 106 may have a tapered tip 144 as shown in FIG. 10, instead of the cylindrical lowered portion 128 shown in FIG. 8. Alternatively, the plug 106 may have a cylindrical tip 148 with a ring-shaped projection 146 as illustrated in FIG. 11. Preferably, the projection 146 is made of rubber or other elastic material. Further, as shown in FIG. 12, the plug 106 may have a tapered tip 144 which is inserted in a hollow cylindrical packing 150 made of elastic material such as plastics or rubber and fitted in the large-diameter portion 108 of the passage 104. In this case, the inner periphery of the packing 150 has a shape complementary to that of the tapered tip 144. Moreover, as shown in FIG. 13, the plug 106 may have the cylindrical tip 148 with the ring-shaped projection 146, and the cylindrical tip 148 may be inserted in a hollow cylindrical packing 152 made of elastic material and fitted in the large-diameter portion 108 of the passage 104. The inner periphery of the packing 152 has a shape complementary to that of the cylindrical tip 148.

Figure 14:
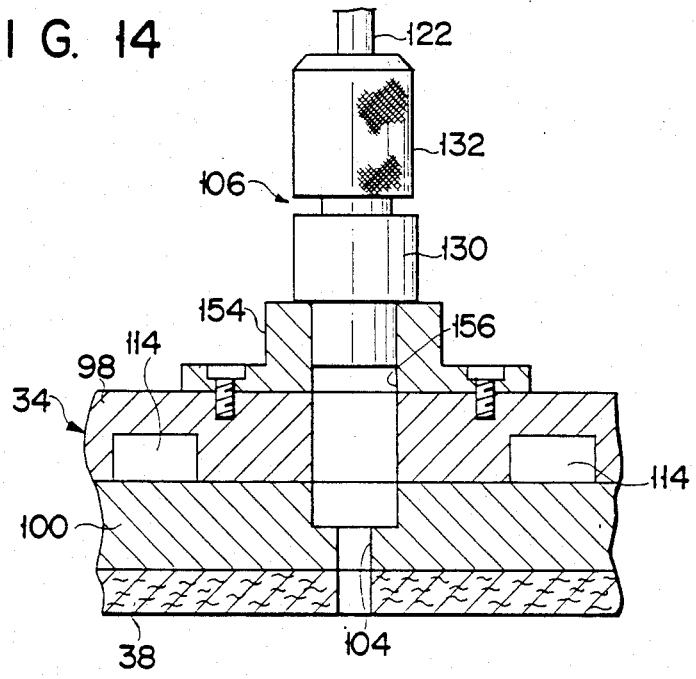
Figure 15:
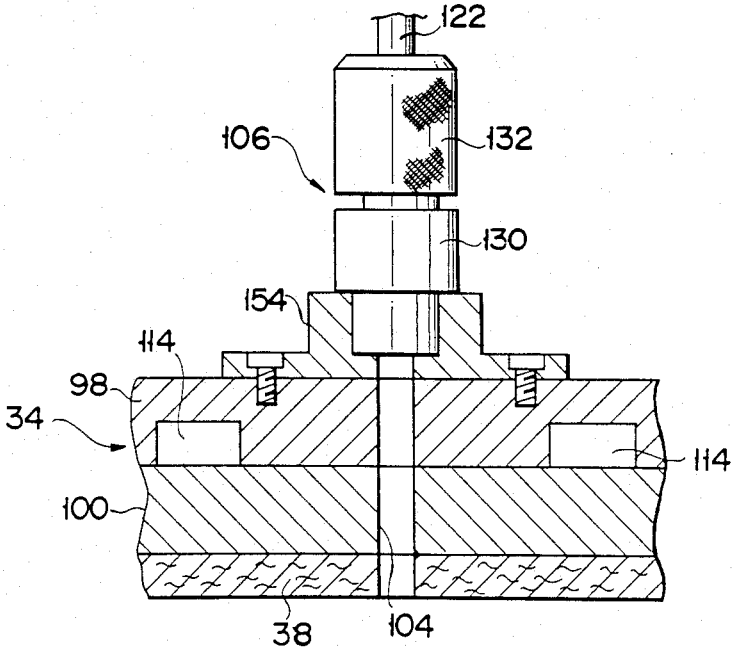

Moreover, as shown in FIG. 14, plug seats 154 each having a through hole 156 may be provided on the upper polishing plate 34, with the through holes 156 axially aligned with the passage 104. The through holes 156 have a shape complementary to the tips of the plugs 106. When the plug seats 154 are used, an upper polishing plate 34 having passages 104 without a step portion as shown in FIG. 15 can be used as well.

In the embodiments described above, two pieces of polishing pad are adhered to the polishing plates 32 and 34. Instead, the polishing pad may be attached to only the upper polishing plate 34, and the wafers may be adhered to the lower polishing plate 32 with wax or an other adhesive agent.

What is claimed is:

1. A method of attaching emery cloth to a machine which can simultaneously polish a plurality of workpieces with slurry and which comprises an upper polishing plate with slurry passages, a lower plate for supporting workpieces, emergy cloth adhered to a lower surface of said upper polishing plate, and plugs attached to said upper polishing plate for supplying slurry to said slurry passages, said method comprising the steps of:

(a) detaching said plugs from said upper polishing plate;

(b) adhering new emergy cloth to said lower surface of said upper polishing plate; then (c) placing a cushion plate on said lower polishing plate; then (d) setting said upper polishing plate on said cushion plate; and then (e) inserting a hole cutter downwardly from said upper surface of said upper polishing plate into said slurry passages until the tip of the hole cutter pierces said new emery cloth adhered to said lower surface of said upper polishing plate, thereby cutting holes in said new emery cloth which communicate with said slurry passages.

2. A method according to claim 1, wherein said cushion plate is so soft that the tip of said hole-cutter can bite into it without being broken.

3. A method according to claim 1, wherein the tip of said hole-cutter is sharp.

4. A method of attaching a new polishing pad to a machine for simultaneously polishing a plurality of work pieces with slurry, said machine comprising:

(a) a lower plate for supporting workpieces mounted thereon;

(b) an upper plate provided above said lower plate for polishing the upper surface of each workpiece mounted on said lower plate, said upper plate having a plurality of slurry passages therethrough, each one of said plurality of slurry passages having a smooth, unthreaded circumferential face at its upper end;

(c) a polishing pad attached to the lower surface of said upper plate, said polishing pad having a plurality of holes therethrough, each one of said holes being in registry with the lower end of a corresponding one on said slurry passages;

(d) slurry supply means for supplying slurry to said plurality of slurry passages, said slurry supply means comprising a plurality of hoses each one of which ends in a coupling having a smooth, unthreaded outer circumferential face, each of said couplings being sized and shaped to be received and frictionally held in the upper end of a corresponding one of said plurality of slurry passages; and (e) means for rotating at least one of said upper and lower plates, said method comprising the steps of:

(f) detaching said couplings from said upper plate;

(g) placing a cushion plate on the upper surface of said lower plate;

(h) removing said polishing pad from the lower surface of said upper plate;

(i) adhering a new polishing pad to the lower surface of said upper plate; then (j) setting said upper plate on said cushion plate; and then (k) inserting a hole-cutter downwardly through each one of said slurry passages in said upper plate and cutting a hole in said new polishing pad with the hole-cutter inserted in each one of said slurry passages in said upper plate.

* * * * *